United States Patent [19]

Niggemeier

[11] 4,264,250

[45] Apr. 28, 1981

[54] CRANE OPERATED RAILWAY TRAILER HITCH

[75] Inventor: Joseph F. Niggemeier, St. Charles, Mo.

[73] Assignee: ACF Industries, Incorporated, New York, N.Y.

[21] Appl. No.: 31,262

[22] Filed: Apr. 18, 1979

[51] Int. Cl.[3] ..... B60P 7/06; B61D 3/16; B61D 45/00; B62D 53/08

[52] U.S. Cl. ..... 410/58; 410/64

[58] Field of Search ..... 108/152; 410/59, 60, 410/61, 62, 63, 64, 58, 65

[56] References Cited

U.S. PATENT DOCUMENTS

| | | | |
|---|---|---|---|
| 3,145,006 | 8/1964 | Robinson et al. | 410/61 |
| 3,202,390 | 8/1965 | Sherrie et al. | 410/64 |
| 3,234,897 | 2/1966 | Berk | 108/152 |
| 3,235,211 | 2/1966 | Robinson et al. | 410/61 |
| 3,346,223 | 10/1967 | Broling | 410/63 |
| 3,358,955 | 12/1967 | Wille et al. | 410/64 |
| 3,497,169 | 2/1970 | Enochian | 410/60 |
| 3,653,621 | 4/1972 | Ferris et al. | 410/62 |

OTHER PUBLICATIONS

American Car and Foundry; Maintenance Manual; Apr. 1972.

*Primary Examiner*—Randolph A. Reese

*Assistant Examiner*—Howard Beltran

*Attorney, Agent, or Firm*—Henry W. Cummings

[57] ABSTRACT

In accordance with the present invention, a trailer hitch is provided including a vertical strut and a diagonal strut which support a hitch head or fifth wheel adapted to engage the kingpin of a highway trailer. Removable pins are provided at the base of the vertical strut to enable the hitch to be pivoted to the retracted position. The vertical strut includes a pair of lifting lugs located on either side of the hitch head and which are each adapted to receive a strong, flexible connection from an overhead crane. The lugs are located inboard of the combined center of mass of the hitch head and the vertical strut toward the diagonal strut a distance sufficient to cause the vertical strut to pivot inboard toward the diagonal strut when the hitch is lifted by the crane. The lugs are located below the hitch head a distance sufficient that the weight of the head and vertical strut forward of the center of mass will at least partially counterbalance the weight of the hitch head and the diagonal strut located inboard of the center of mass. In addition, the base of the diagonal strut is curved to facilitate the hitch sliding on the deck between retracted and extended positions. With this arrangement and an overhead crane, a single operator can move the hitch between extended and retracted positions, and can load a trailer on a flat car or unload a trailer from a flat car.

11 Claims, 5 Drawing Figures

CRANE OPERATED RAILWAY TRAILER HITCH

BACKGROUND OF THE INVENTION

U.S. Pat. No. 3,145,006 discloses railway trailer hitches including a vertical strut and a diagonal strut supporting a hitch head or fifth wheel. The hitch is movable between a retracted position on the deck to allow tractor trailers to pass over the hitch, and an extended position adapted to engage the kingpin of a railway trailer by means of a manually operable elevating screw.

The head of the fifth wheel includes a fixed lock block and a movable lock block. An operating screw is rotated to move the movable lock block between a closed position engaging a trailer kingpin and an open position allowing exit of the kingpin. Further information concerning this type of hitch can be obtained from the above patents and from the ACF Maintenance Manual, Model V Trailer Hitch, ACF Industries, Amcar Division, Main and Clark Streets, St. Charles, Mo. 63301 (copy in application file).

The elevating screw for raising and lowering the hitch adds considerably to the cost of this hitch. In many trailer loading and unloading yards an overhead crane is available for lifting various articles in the yard, including loading trailers on flat cars and unloading trailers from flat cars and/or from barges.

Many other hitches contain a complicated linkage to move the hitch to a retracted position by a tractor bumper bar. See, for example, U.S. Pat. No. 3,234,897. This linkage is also expensive and can jam, causing the hitch to be inoperative.

SUMMARY OF THE INVENTION

The object of the present invention is to provide a trailer hitch in which an overhead crane is utilized to raise and lower the hitch between retracted and extended positions.

Another object of the present invention is to provide a trailer hitch in which, during raising and lowering of the hitch with an overhead crane, the weight of the hitch is generally balanced about a fulcrum or pivot point, whereby a single operator can easily provide the necessary force to raise and lower the hitch between retracted and extended positions.

In accordance with the present invention, a trailer hitch is provided including a vertical strut and a diagonal strut which support a hitch head or fifth wheel adapted to engage the kingpin of a highway trailer. The diagonal strut is pivotably mounted about diagonal strut lugs at the base of the diagonal strut. The vertical strut includes a pair of lifting lugs located on either side of the hitch head and which are each adapted to receive a strong, flexible connection from an overhead crane. The lifting lugs are located inboard of the combined center of mass of the hitch head and the vertical strut toward the diagonal strut a distance sufficient to cause the vertical strut to pivot inboard toward the diagonal strut when the hitch is lifted by the crane. Preferably this distance is at least one (1) inch to allow some latitude in orienting the crane over the center of the hitch. The lifting lugs are located below the hitch head a distance sufficient that the weight of the head and vertical strut forward or outboard of the center of mass will at least partially counterbalance the weight of the hitch head and the diagonal strut located inboard of the center of mass. This distance is preferably four and one-half (4½) to seven (7) inches below the center of the head for a standard 47" hitch in extended position. For hitches of non-standard height the lifting lugs are preferably located one-seventh (1/7) to one-ninth (1/9) of the distance from the hitch head to the base of the vertical strut. Removable pins are provided at the base of the vertical strut to enable the hitch to be pivoted to the retracted position. In addition, the base of the diagonal strut is curved to facilitate the hitch sliding on the deck between retracted and extended positions. The lifting lugs on the sides of the vertical strut include a slot to allow the hitch head to nest in the retracted position.

With this arrangement and an overhead crane, a single operator can move the hitch between extended and retracted positions and can load a trailer on a flat car or unload a trailer from a flat car.

THE DRAWINGS

DESCRIPTION OF PREFERRED EMBODIMENTS

Figure 1:
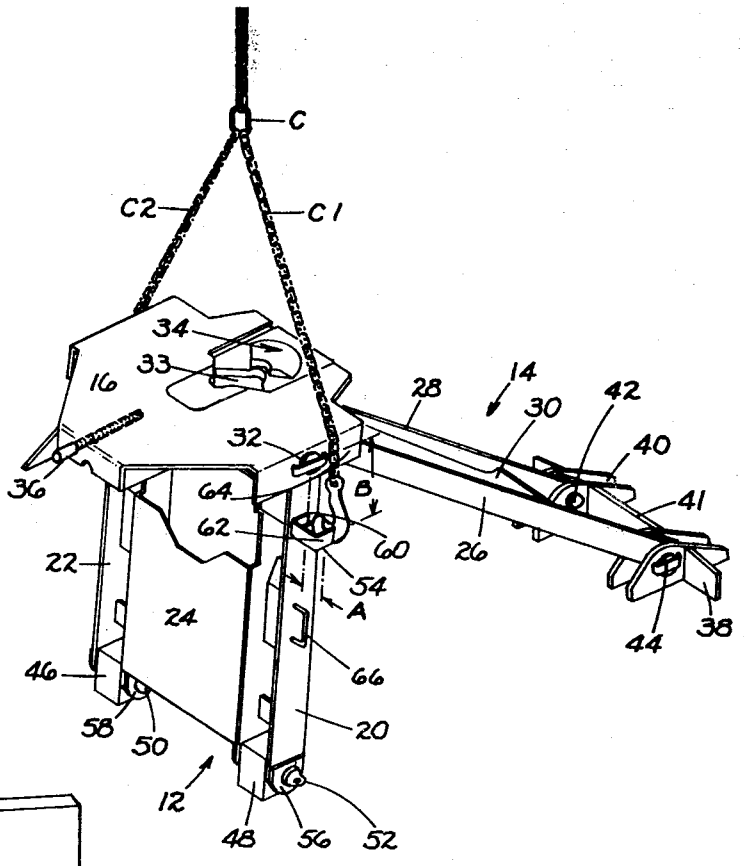
FIG. 1 is a perspective view of the hitch of the present invention in operative, extended position.

The hitch of the present invention is shown in the drawings at 10.

The hitch includes a vertical strut 12 and a diagonal strut 14 which engage and support a hitch head 16. The vertical strut includes a pair of channel beams 20 and 22 joined by a transverse plate 24. The diagonal strut includes beams 26 and 28 also joined by a plate 30. The hitch head 16 includes pins 32 which engage the beams 20, 22, 26 and 28 and holds them in engagement with the head 16.

The head includes a movable locking portion 34 which is movable back and forth between an engaged position holding in place the kingpin of a highway trailer, and a disengaged position allowing a highway trailer to enter or exit. An operating screw 36 may be used to move portion 34 back and forth as described in greater detail hereinafter and in U.S. Pat. Nos. 3,145,006; 3,235,211 and the ACF Model V Trailer Hitch Maintenance Manual, ACF Industries, Inc., Amcar Division, Main and Clark Streets, St. Charles, Mo. 63301, hereby incorporated into the present application by this reference. (Copy in application file.)

Diagonal strut lugs 38 and 40 include an optional transverse connector 41. Pins 42 and 44 are provided which pivotably mount diagonal strut 14.

The vertical strut is connected to a pair of vertical strut lugs 46 and 48 by means of removable pins 50 and 52.

In accordance with the invention, the vertical strut includes a pair of lifting lugs 54 and 55 located on either side of the hitch head 16 and which are each adapted to receive strong, flexible connections $C_1$ and $C_2$ from an overhead crane C. The lifting lugs 54 and 55 are located inboard of the combined center of mass of the hitch head and the vertical strut M toward the diagonal strut a distance A sufficient to cause the vertical strut to pivot inboard toward the diagonal strut when the pins 50 and 52 are removed and the hitch is lifted by the crane. Preferably this distance is at least one (1) inch to allow some latitude in orienting the crane over the center of the hitch. The lifting lugs are located below the hitch head a distance B sufficient that the weight of the head and vertical strut forward of the center of mass will at least partially counterbalance the weight of the hitch head and the diagonal strut located inboard of the center of mass M. This distance B is preferably four and one-half ($4\frac{1}{2}$) to seven (7) inches below the center of the hitch head for a standard hitch in which the hitch head is located 47" above the deck or base plate in extended position. For hitches of non-standard height, the lugs 54 and 55 are preferably located one-seventh (1/7) to one-ninth (1/9) of the distance from the hitch head to the deck or base plate.

Removable pins 50 and 52 at the base of the vertical strut 12 are removed to enable the hitch to be pivoted to the retracted position. In addition, the base of the diagonal strut is curved, preferably in a semi-circle at 56 and 58 to facilitate the hitch sliding on the deck between retracted and extended positions.

Figure 2:
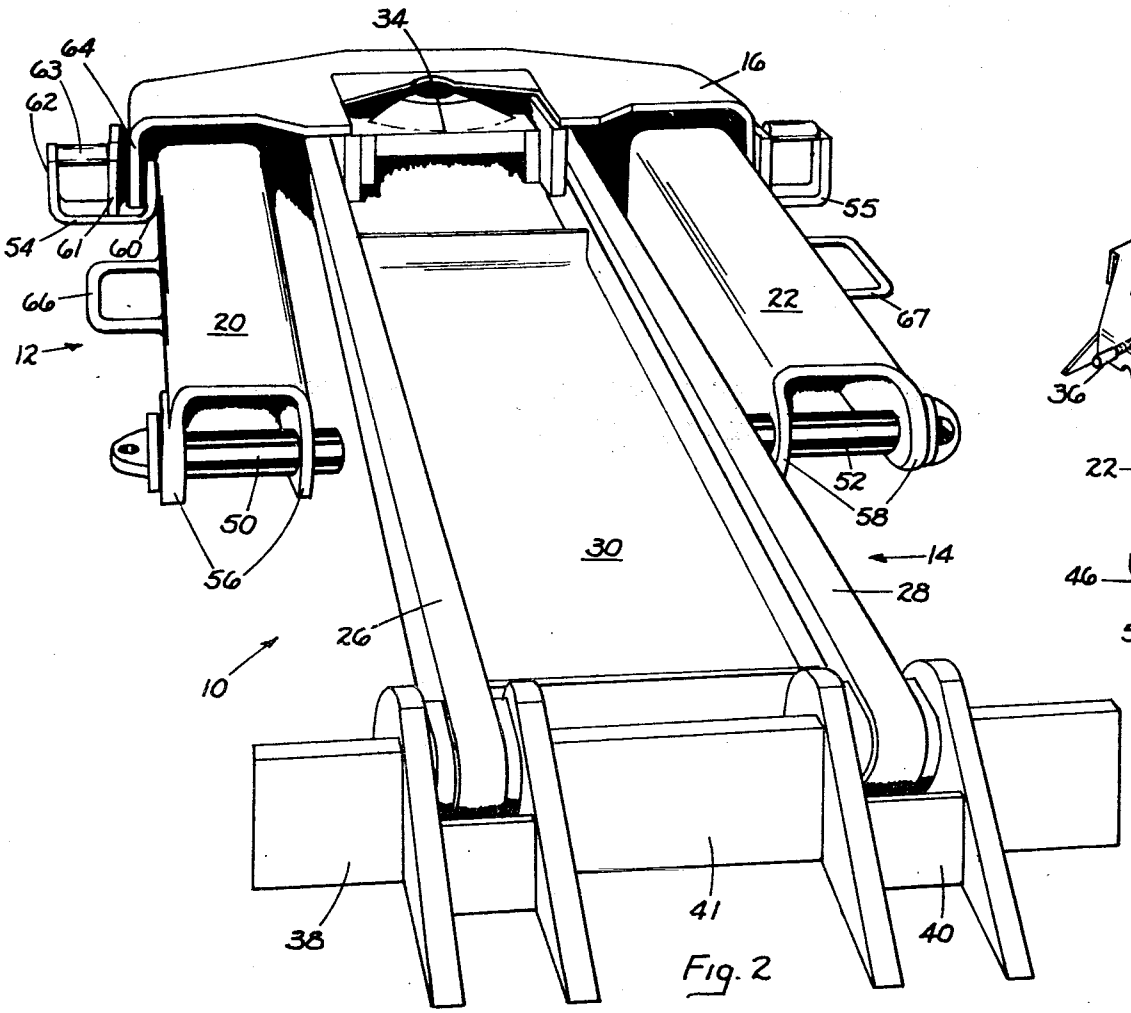
FIG. 2 is a perspective view of the hitch of the present invention in retracted position.

The lugs 54 and 55 are constructed in the same manner and are generally U-shaped and include three legs 60, 61 and 62. A round rod portion 63 extends between legs 61 and 62 to facilitate engagement of the overhead crane. The distance between legs 60 and 61 is sufficiently great to allow the depending flange 64 of the top plate to nest therein in the retracted position shown in FIG. 2.

Handles 66 and 67 are provided on the vertical strut 16 to assist the operator in moving the hitch between extended and retracted positions while the hitch is supported by the overhead crane.

To load a trailer on a flat car or barge, the crane arms $C_1$ and $C_2$ are first connected to lifting lugs 54 and 55 and the hitch will move upwardly and outwardly relative to diagonal strut lugs 38 and 40. Rounded portions 56 and 58 will assist movement of the vertical strut along the deck or base plate. When the vertical strut aligns with lugs 48 and 50, removable pins 50 and 52 are inserted to hold the hitch in upright position. The crane arms can then be disconnected from the lugs 54 and 55.

The crane C may then be used to move a trailer onto the flat car or barge. The kingpin is inserted with the opening 33 in the hitch head and operating screw is utilized to move movable portion 34 into engaged position holding the kingpin in place.

To retract the hitch, the movable portion 34 is first moved to disengaged position from the kingpin. Then the crane is orientated over the hitch and the arms are connected to lugs 54 and 55. Pins 50 and 52 are removed and the crane is used to lift the hitch. Vertical strut 12 pivots inwardly under diagonal strut 26. Curved surfaces 56 and 58 aid the vertical strut in sliding into the retracted position shown in FIG. 2. It is apparent that with this arrangement a single operator can move the hitch between extended and retracted positions with an overhead crane, and can load a trailer on a flat car or unload a trailer from a flat car.

Figure 3:
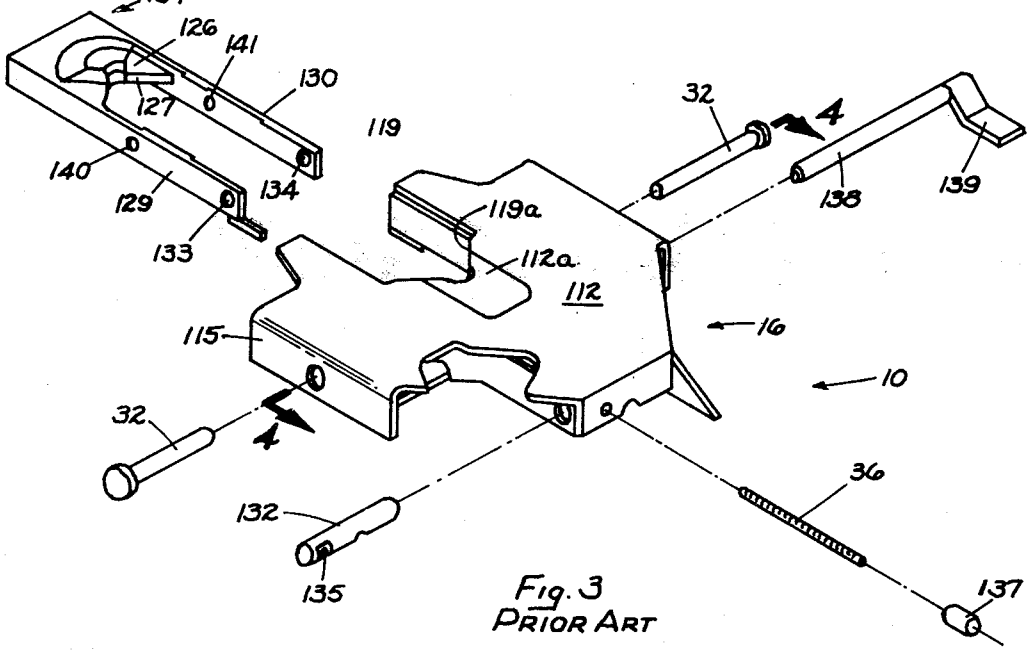
Fig. 3 PRIOR ART
FIG. 3 is an exploded perspective view of a fifth wheel for trailer hitches.

The expense of the elevating screw to raise and lower the hitch and the expense of a bumper bar knock-down linkage can thus be avoided with the hitch of the present invention. In order to describe a complete embodiment as shown in FIG. 3, trailer hitch 10 includes a fifth wheel 16 having a top plate 112 including a fixed jaw **112*a* made of a hardened steel forging and depending flanges 115**.

The top plate 112 includes an enlarged slot 119 which terminates at one end thereof and at its other includes diverging gatherin surfaces **119*a***.

Figure 4:
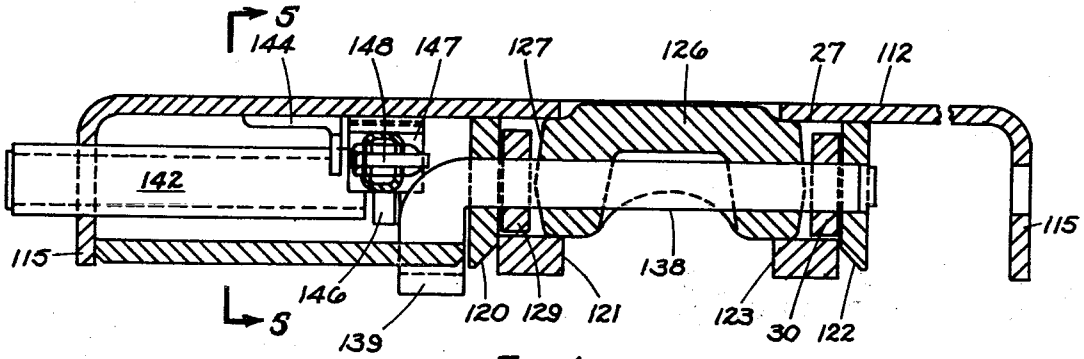
Fig. 4 PRIOR ART
FIG. 4 is a sectional view looking in the direction of the arrows along the line 4—4 in FIG. 3.

As shown in FIG. 4 a pair of depending vertical plates 120 and 122 are welded to the lower surface of top plate 112. The movable jaw assembly indicated generally at 134 includes a movable jaw 126 having tapered guide surfaces 127 and a pair of extensions 129 and 130. As shown in FIG. 4, the extensions 129 and 130 are located within vertical plates 120 and 122. Movable jaw 126 is supported by horizontally extending plates 121 and 123 welded to respective vertical plates 120 and 122.

A transversely extending pin 132 is located within openings 133 and 134 within extensions 129 and 130. This pin includes a threaded opening 135 adapted to receive a longitudinally extending operating shaft 36 which is externally threaded. A tool connector 137 of square or hexagon cross section is provided to allow attachment of a suitable tool to rotate shaft 36 and move movable jaw 126 backward and forward between open and closed positions. A transversely extending locking pin 138 having a handle 139 is provided which enters openings 140 and 141 within movable jaw extensions 129 and 130 when the movable jaw is in the closed position.

Figure 5:
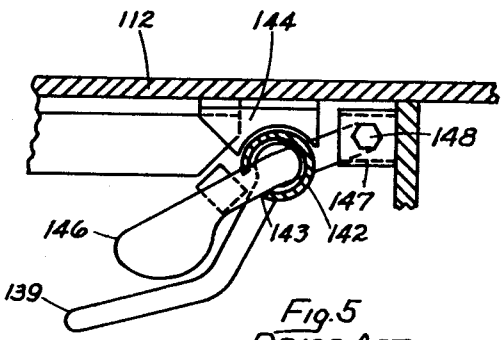
Fig. 5 PRIOR ART
FIG. 5 is a cross-sectional view taken substantially along the line 5—5 in FIG. 4.

A tube 142 having a slot 143 is welded to a bracket 144 depending from top plate 112 (FIG. 5). A locking lever 146 is pivotally mounted about a bracket 147 by means of a pin 148. When the movable jaw assumes the closed position, locking pin 138 is inserted through slotted tube 142. When the locking pin 138 and handle 139 assumes the closed position shown in FIG. 4, the locking lever 146 is free to pivot about the pin 148 and assume the depending position shown in FIG. 5. The locking pin 138 cannot be removed from the closed position shown in FIG. 5 until the locking lever 146 is moved out of the way and locking pin 138 is moved outwardly through slotted tube to release movable jaw 126. The foregoing construction is that of a commercially available trailer hitch. For a more detailed description see the ACF Maintenance Manual, Model V Trailer Hitch, ACF Industries, Amcar Division, Main and Clark Streets, St. Charles, Mo. 63301, referred to above.

What is claimed is:

1. A trailer hitch comprising: a vertical strut and a diagonal strut which support a hitch head adopted to engage the kingpin of a highway trailer diagonal strut; diagonal strut lug means for pivotably mounting said diagonal strut at its base; removable pins connecting said vertical strut at its lower end to a hitch support; said vertical strut including a pair of lifting lugs located on the exterior position of the vertical strut on each side of the hitch head and which are each adopted to receive a vertical strut connection from an overhead crane; said lifting lugs being located inboard of the combined center of mass of the hitch head and the vertical strut toward the diagonal strut a distance sufficient to cause the diagonal strut to pivot inboard and toward said diagonal strut lug means when the hitch is lifted by an overhead crane engaging each of said lifting lugs; said lifting lugs further being located below said hitch head a distance sufficient that the weight of the head and said vertical strut forward of said center of mass at least partially counterbalances the weight of the hitch head and the diagonal strut located inboard of said center of mass whereby said hitch can be moved between extended and retracted positions.

2. A hitch according to claim 1 wherein said inboard distance is sufficient to allow some latitude in orienting the crane over the center of the hitch.

3. A hitch according to claim 1 wherein the base of said vertical strut is curved to facilitate the hitch sliding on support structure between retracted and extended positions.

4. A hitch head according to claim 1 wherein said lifting lugs include a slot to allow the hitch head to nest in the retracted position.

5. A hitch according to claim 1 wherein said lifting lugs are located below the hitch head about one-seventh (1/7) to one-ninth (1/9) of the distance of said vertical strut.

6. A hitch according to claim 5 wherein said lifting lugs are four and one-half (4½) to seven (7) inches below the center of the hitch head for a standard 47" vertical strut hitch in extended position.

7. A trailer hitch comprising: a vertical strut and a diagonal strut which support a hitch head adopted to engage the kingpin of a highway trailer diagonal strut; diagonal strut lug means for pivotably mounting said diagonal strut at its base; removable pins connecting said vertical strut to a hitch support; such vertical strut including a pair of lifting lugs located on the exterior portion of the vertical strut on each side of the hitch head and which are each adopted to receive a vertical strut connection from an overhead crane; said lifting lugs being located inboard of the combined center of mass of the hitch head and the vertical strut toward the diagonal strut a sufficient distance to cause the diagonal strut to pivot inboard and toward said diagonal strut lug means when the hitch is lifted by an overhead crane engaging each of said lifting lugs; said lifting lugs further being located below said hitch head a distance sufficient that the weight of the head and said vertical strut forward of said center of mass at least partially counterbalances the weight of the hitch head and the diagonal strut located inboard of said center of mass whereby said hitch can be moved between extended and retracted positions; said vertical strut including a base portion having a lower surface which is curved to facilitate the hitch sliding on support structure between retracted and extended positions.

8. A hitch head according to claim 7 wherein said lifting lugs include a slot to allow the hitch head to nest in the retracted position.

9. A hitch according to claim 7 wherein said second lower surface is in the form of a semi-circle.

10. A hitch according to claim 7 wherein said lifting lugs are located below the hitch head about one-seventh (1/7) to one-ninth (1/9) of the distance of said vertical strut.

11. A hitch according to claim 10 wherein said lifting lugs are four and one-half (4½) to seven (7) inches below the center of the hitch head for a standard 47" height vertical strut hitch in extended position.

* * * * *